US012329232B2

(12) United States Patent
Hughes

(10) Patent No.: US 12,329,232 B2
(45) Date of Patent: Jun. 17, 2025

(54) SELF-OPENING SHOE

(71) Applicant: Foot Scientific, Inc., Draper, UT (US)

(72) Inventor: Christopher Robert Hughes, Draper, UT (US)

(73) Assignee: Foot Scientific, Inc., Draper, UT (US)

( * ) Notice: Subject to any disclaimer, the term of this patent is extended or adjusted under 35 U.S.C. 154(b) by 797 days.

(21) Appl. No.: 16/898,333

(22) Filed: Jun. 10, 2020

(65) Prior Publication Data

US 2020/0383424 A1 Dec. 10, 2020

Related U.S. Application Data

(60) Provisional application No. 62/859,714, filed on Jun. 10, 2019.

(51) Int. Cl.

| | |
|---|---|
| ***A43B 11/00*** | (2006.01) |
| ***A43B 23/02*** | (2006.01) |
| ***A43B 23/22*** | (2006.01) |

(52) U.S. Cl.

CPC ..... *A43B 11/00* (2013.01); *A43B 23/0245* (2013.01); *A43B 23/222* (2013.01)

(58) Field of Classification Search

CPC ..... A43B 11/00

See application file for complete search history.

(56) References Cited

U.S. PATENT DOCUMENTS 1,686,175 A * 10/1928 Read ..... A43B 3/101 36/58.5
1,793,212 A * 2/1931 Dike ..... A43B 3/16 36/50.1
5,054,216 A * 10/1991 Lin ..... A43B 3/00 36/138
8,499,474 B2 * 8/2013 Kaufman ..... A43C 11/00 36/138
8,904,673 B2 12/2014 Johnson et al.
9,265,305 B2 2/2016 Hatfield et al.
9,351,532 B2 5/2016 Mokos
9,839,261 B2 12/2017 Hatfield et al.
9,854,875 B2 1/2018 Hatfield et al.
9,877,542 B2 * 1/2018 Pratt ..... A43B 11/00
10,306,947 B2 6/2019 Pratt et al.
10,455,898 B1 * 10/2019 Orand ..... A43C 11/004
(Continued)

OTHER PUBLICATIONS

USPTO as International Searching Authority, "International Search Report and Written Opinion," International Application No. PCT/US2020/037086, Sep. 2, 2020.

*Primary Examiner* — Megan E Lynch
(74) *Attorney, Agent, or Firm* — Dentons Durham Jones Pinegar

(57) ABSTRACT

A shoe-opening spring includes a base with a medial edge and a lateral edge, a medial spring protruding upwardly from the medial edge of the base, and a lateral edge protruding upwardly from the lateral edge of the base. When the shoe-opening spring is present within a shoe and in a relaxed arrangement, the medial spring and the lateral spring may respectively exert medially and laterally outward forces against respective medial and lateral sides of the shoe. When the medial and lateral sides of the upper of the shoe are pulled together, for example, with a closure of the shoe, the shoe-opening spring may be placed in a tensed arrangement, in which state the shoe-opening spring may remain until the closure is released.

13 Claims, 6 Drawing Sheets

(56) References Cited

U.S. PATENT DOCUMENTS

| | | | | |
|---|---|---|---|---|
| 10,506,842 | B2 | 12/2019 | Pratt et al. | |
| 10,555,578 | B2 | 2/2020 | Pratt | |
| 2001/0034958 | A1* | 11/2001 | Kaneko | A43B 23/08 36/58.5 |
| 2005/0081404 | A1* | 4/2005 | Hurd | A43B 11/02 36/89 |
| 2008/0184592 | A1 | 8/2008 | Brie et al. | |
| 2009/0019736 | A1* | 1/2009 | Ng | A43B 11/00 36/51 |
| 2016/0302530 | A1* | 10/2016 | Smith | A43C 11/00 |
| 2017/0224055 | A1* | 8/2017 | Hooper | A43C 11/008 |
| 2018/0110285 | A1 | 4/2018 | Cohen | |
| 2018/0110289 | A1* | 4/2018 | Owings | A43B 13/141 |
| 2018/0279716 | A1* | 10/2018 | Fersaci | A43B 11/00 |
| 2020/0205511 | A1 | 7/2020 | Hopkins et al. | |

* cited by examiner

SELF-OPENING SHOE

CROSS-REFERENCE TO RELATED APPLICATION

A claim for priority to the Jun. 10, 2019 filing date of U.S. Provisional Patent Application 62/859,714, titled SELF-OPENING SHOE ("the '714 Provisional application") is hereby made pursuant to 35 U.S.C. § 119(e). The entire disclosure of the '714 Provisional application is hereby incorporated herein.

TECHNICAL FIELD

This disclosure relates generally to shoes and, more specifically, to shoes with features that make them easier to put on and, optionally, to take off. Even more specifically, this disclosure relates to self-opening shoes.

BACKGROUND

Many individuals struggle to reach down with both hands to open their shoe, insert their foot into the shoe, and the secure the shoe onto their foot. This often happens when an individual suffers from limited mobility, lower back pain, or other maladies.

SUMMARY

In one aspect, a self-opening shoe is disclosed. A self-opening shoe may include a shoe and a shoe-opening spring. The shoe may comprise a conventional shoe, with which the self-opening spring may be assembled (e.g., into which the shoe-opening spring may be inserted, etc.). Alternatively, a shoe-opening spring may be incorporated into a self-opening shoe while manufacturing the self-opening shoe.

Regardless of whether the self-opening spring is insertable into and optionally removable from an existing shoe or the self-opening spring is integrated into a self-opening shoe, the shoe may be any type of shoe with any suitable construction. Among various other features, the shoe may include a foot bed, an upper over the foot bed, and a closure. The upper may include, among various other features, a medial side with an upper medial portion and an upper medial edge, a lateral side with an upper lateral portion and an upper lateral edge, a collar, and a tongue.

When an individual's foot has been introduced into the shoe, the medial side of the upper may cover a medial side of the foot and the lateral side of the upper may cover a lateral side of the foot. The upper medial portion of the medial side of the upper may extend, or wrap, over a medial side of the top of the foot, while the upper lateral portion of the lateral side of the upper may extend, or wrap, over a lateral side of the top of the foot.

The collar extends around a back of the shoe, connecting the upper medial edge of the medial side of the upper and the lateral medial edge of the lateral side of the upper. The collar defines an opening of the shoe, into which the individual may introduce his or her foot into the shoe. When the shoe has been placed on an individual's foot, the collar may extend around the individual's ankle.

The tongue of the shoe may be positioned beneath the upper medial portion and the upper medial edge of the medial side of the upper of the shoe and beneath the upper lateral portion and the upper lateral edge of the lateral side of the upper.

The closure may be associated with the upper medial edge of the upper medial portion of the medial side of the upper of the shoe and the upper lateral edge of the upper lateral portion of the lateral side of the upper of the shoe. When the closure is tightened, or placed in a closed state, the closure may pull the upper medial edge and the upper lateral edge toward one another and reduce a size of the opening of the shoe. When the closure is loosened, or placed in an open state, the upper medial edge and the upper lateral edge may be pulled apart from each other, enabling the size of the opening to be increased or even maximized. Without limitation, the closure may comprise a lacing system (e.g., one or more laces and eyelets or equivalent features), one or more straps, or any other type of suitable closure associated with the upper medial edge and the upper lateral edge of the upper of the shoe.

The shoe-opening spring may exert a medially outward force that urges the upper medial edge of the upper medial portion of the medial side of the upper of the shoe in a medial direction. The shoe-opening spring may exert a laterally outward force that urges the upper lateral edge of the upper lateral portion of the lateral side of the upper of the shoe in a lateral direction. Thus, the shoe-opening spring may force the upper medial edge and the upper lateral edge apart, increasing the size of the opening of the shoe. Additionally, the shoe-opening spring may facilitate a transition of the closure of the shoe from its closed state to its open state.

In a specific embodiment, the shoe-opening spring may include a base, a medial spring protruding upwardly from the base and, optionally, outwardly relative to the base, and a lateral spring. The base may comprise an elongated element that extends across a foot bed of the shoe. The base may include a medial end and a lateral end, which may be opposite from one another. The medial end of the base may be positionable adjacent to the medial side of the upper of the shoe. The lateral end of the base may be positionable adjacent to the lateral side of the upper. In some embodiments, the base may have a convex curvature (i.e., it may bow upwardly at or near its center) between the medial spring and the lateral spring. In such embodiments, flattening of the base, as may occur as an individual presses against convex curvature of the base with his or her foot, may draw the medial spring and the lateral spring toward one another.

The medial spring of the shoe-opening spring may extend upwardly and, optionally, outwardly from the medial end of the base. When the shoe-opening spring and the medial spring thereof are in the open state, the medial spring may force the upper medial portion of the medial side of the upper of the shoe medially outward. More specifically, the medial spring may exert a medially outward force sufficient to force the medial side of the upper of the shoe, including the upper medial portion and upper medial edge of the medial side, medially outward a desired medial distance. The lateral spring may exert a laterally outward force sufficient to force the lateral side of the upper of the shoe, including the upper lateral portion and upper lateral edge of the lateral side, laterally outward a desired lateral distance. The medial distance and the lateral distance may enlarge the opening defined by the collar of the upper the shoe to a desired extent (e.g., to an extent sufficient to enable an individual's foot to be inserted into the opening and introduced into the shoe with little or no resistance, etc.).

When the shoe-opening spring and the lateral spring thereof are in the open state, the lateral spring may force the upper lateral portion of the lateral side of the upper of the shoe laterally outward. As a result, the medial spring and the lateral spring of the shoe-opening spring may together increase or even maximize the size of the opening defined by the collar of the upper of the shoe, thereby facilitating introduction of a foot into the opening and into the shoe, as well as removal of the foot from the shoe.

Conversely, when the medial spring and the lateral spring of the shoe-opening spring are forced towards each other, the shoe-opening spring, its medial spring, and its lateral spring may be placed in a tensed arrangement. The medial spring and the lateral spring may be forced towards each other when the closure of a shoe with which the shoe-opening spring has been assembled is placed in a closed state. When in the tensed arrangement, the shoe-opening spring may store energy.

Energy stored by the shoe-opening spring may be subsequently released, for example, when the closure of a shoe with which the shoe-opening spring has been assembled is placed in an open state. As the shoe-opening spring within a shoe releases stored energy, the medial spring may urge the medial side of the upper of the shoe medially outward and the lateral side of the shoe laterally outward. Thus, the release of energy by the shoe-opening spring may force the upper medial edge and upper lateral edge of the upper of the shoe apart from one another, increasing the size of the opening defined by the collar of the upper of the shoe. In addition, the release of energy by the spring and the resulting outward movement of the medial spring and lateral spring may forcing the closure further into its open state, which may loosen the closure.

In embodiments where the shoe-opening spring is incorporated into a shoe during its manufacture, or the shoe-opening spring comprises part of the construction of the shoe, shoe-opening spring may be incorporated into the shoe in such a way as to maximize comfort for an individual as he or she wears the shoe on his or her foot. In some embodiments, the shoe-opening spring may be incorporated into a shoe in a manner that prevents it from being felt by an individual as he or she wears the shoe on his or her foot. More specifically, a configuration of the shoe-opening spring may prevent it from exerting pressure on the lateral and medial sides of a foot that has been placed in the shoe. The base of the shoe-opening spring may be positioned beneath an insole of the shoe. The medial spring of the shoe-opening spring may be incorporated into the medial side of the upper of the shoe. The lateral spring of the shoe-opening spring may be incorporated into the lateral side of the upper of the shoe.

According to another aspect, a shoe-opening spring is disclosed. Such a shoe-opening spring, which may include any of the features described above, may be incorporated into a shoe during its manufacture or inserted into an existing shoe.

In another aspect, methods for facilitating the introduction of a foot into a shoe are disclosed. Such a method may include providing a shoe-opening spring therein. For example, the shoe-opening spring may be provided within the shoe by inserting the shoe-opening spring into an existing shoe. As another example, the shoe-opening spring may be provided within the shoe as the shoe is manufactured. With the shoe-opening spring in place within the shoe and a closure of the shoe in an open state, the shoe-opening spring may force a medial side of an upper of the shoe medially outward and a lateral side of the upper of the shoe laterally outward, which may increase a size of an opening of the shoe.

With the opening of the shoe enlarged by the shoe-opening spring, a foot of an individual may be inserted into the opening and introduced into the shoe. Once the foot has been properly positioned within the shoe (i.e., once the shoe is on the foot), the upper of the shoe may be secured in place over the foot. For example, a closer of the shoe may be placed in its closed state. When the upper of the shoe is secured in place of the foot, the size of the opening of the shoe may decrease and tension may be introduced into the shoe-opening spring.

Removal of the shoe from the foot may include loosening the shoe from the foot, which may enable the tension to be released from the shoe-opening spring. As the shoe-opening spring releases tension, it may force the medial side of the upper of the shoe medially outward, force the lateral side of the upper of the shoe laterally outward, and increase the size of the opening of the shoe. With the size of the opening increased, the foot may be removed with little or no resistance from the shoe.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
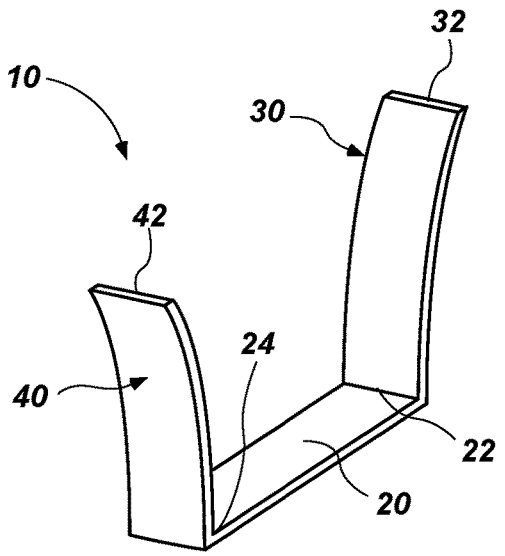
FIGS. 1 and 2 illustrate an embodiment of a shoe-opening spring according to this disclosure in a relaxed arrangement, with the shoe-opening spring including a base, a medial spring extending upwardly and, optionally, outwardly from a medial end of the base, and a lateral spring extending upwardly and, optionally, outwardly from a lateral end of the base.

With reference to FIGS. 1-4, an embodiment of a shoe-opening spring 10 is illustrated. The shoe-opening spring 10 includes a base 20, a medial spring 30, and a lateral spring 40. The base 20 comprises an elongated element with a medial end 22 and a lateral end 24 on opposite sides thereof. The medial spring 30 protrudes upwardly from the medial end 22 of the base 20. As illustrated, the medial spring 30 may also extend somewhat outwardly, or medially, from the medial end 22 of the base 20. The lateral spring 40 protrudes upwardly from the lateral end 24 of the base 20. As illustrated, the lateral spring 40 may also extend somewhat outwardly, or laterally, from the lateral end 24 of the base 20.

The shoe-opening spring 10, including its base 20, its medial spring 30, and its lateral spring 40, may be defined from a single piece of material. As an example, the shoe-opening spring 10 may be defined from a strip of metal (e.g., a spring steel, etc.) that has been bent to define the various features of the shoe-opening spring; i.e., its base 20, its medial spring 30, and its lateral spring 40. Alternatively, the shoe-opening spring 10 may be defined from a rigid, but somewhat flexible plastic material or a composite material (e.g., a carbon fiber-reinforced plastic material, etc.). The use of other materials and corresponding manufacturing processes are also within the scope of this disclosure. The flexibility of the material may enable it to at least partially conform to an individual's foot as tension is introduced into the shoe-opening spring 10. The flexibility and rigidity of the material may enable it to store energy as tension is introduced into the shoe-opening spring 10.

Figure 2:
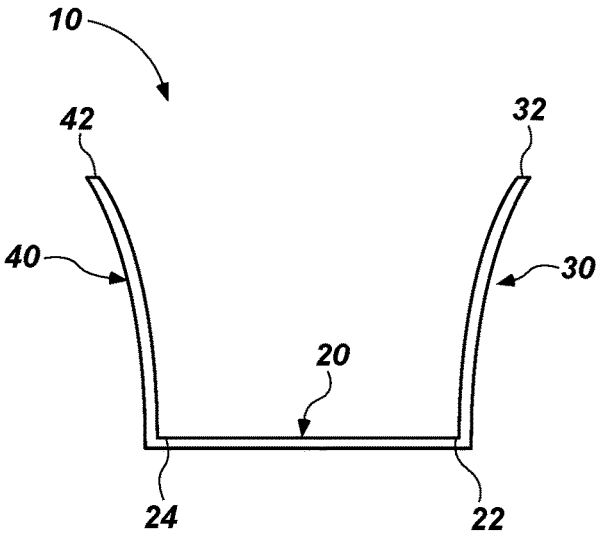
Figure 3:
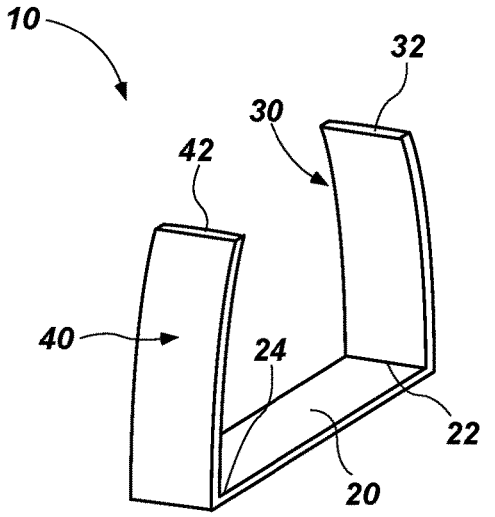
FIGS. 3 and 4 depict the embodiment of the shoe-opening spring of FIGS. 1 and 2 in a tensed arrangement.
Figure 4:
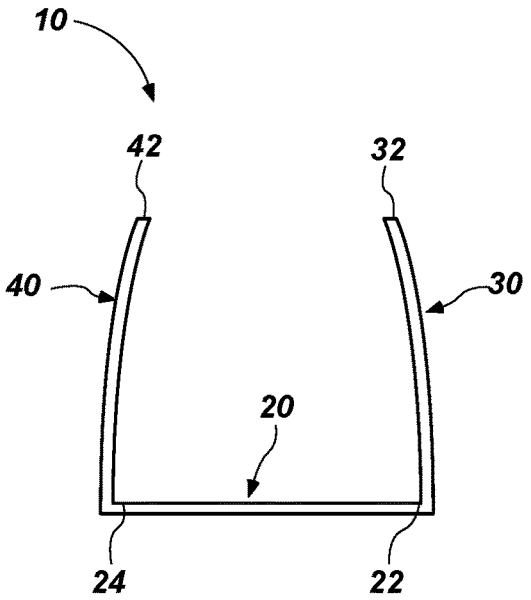

In FIGS. 1 and 2, the shoe-opening spring 10 is shown in a relaxed arrangement, in which it does not store energy. As illustrated by FIGS. 1 and 2, the medial spring 30 and the lateral spring 40 of the shoe-opening spring 10, along with the respective ends 32 and 42 of the medial spring 30 and the lateral spring 40, are oriented relatively far apart from one another. As the medial spring 30 and the lateral spring 40 of the shoe-opening spring 10 are forced toward one another, as illustrated by FIGS. 3 and 4, tension is introduced into the shoe-opening spring 10, as well as into its medial spring 30 and into its lateral spring 40, placing the shoe-opening spring 10, its medial spring 30, and its lateral spring 40 in a tensed arrangement. While in the tensed arrangement, the shoe-opening spring 10 stores energy that urges the medial spring 30 medially outward and the lateral spring 40 laterally outward.

Turning now to FIGS. 5-9, another embodiment of shoe-opening spring 10' is depicted. The shoe-opening spring 10' includes a base 20', a medial spring 30', and a lateral spring 40'. The base 20' comprises an elongated element with a medial end 22' and a lateral end 24' on opposite sides thereof. The medial spring 30' protrudes upwardly from the medial end 22' of the base 20'. The lateral spring 40' protrudes upwardly from the lateral end 24' of the base 20.

The base 20' of the shoe-opening spring 10' may be bowed, or it may have a convex curvature between the medial spring 30' and the lateral spring 40'. An inner surface 34' of the medial spring 30' may have a concave shape or a concave curvature. An inner surface 44' of the lateral spring 40' may have a concave shape of a concave curvature. The concave shapes of the inner surfaces 34' and 44' of the medial spring 30' and the lateral spring 40' may enable the medial spring 30' and the lateral spring 40' to respectively receive the medial and lateral sides of an individual's foot.

The shoe-opening spring 10', including its base 20', its medial spring 30', and its lateral spring 40', may be defined from a single piece of material. As an example, the shoe-opening spring 10' may be defined from a strip of metal (e.g., a spring steel, etc.) that has been bent to define the various features of the shoe-opening spring; i.e., its base 20', its medial spring 30', and its lateral spring 40'. Alternatively, the shoe-opening spring 10' may be defined from a rigid, but somewhat flexible plastic material or a composite material (e.g., a carbon fiber-reinforced composite material, etc.). The use of other materials and corresponding manufacturing processes are also within the scope of this disclosure. The flexibility of the material may enable it to at least partially conform to an individual's foot as tension is introduced into the shoe-opening spring 10'. The flexibility and rigidity of the material may enable it to store energy as tension is introduced into the shoe-opening spring 10'.

Figure 5:
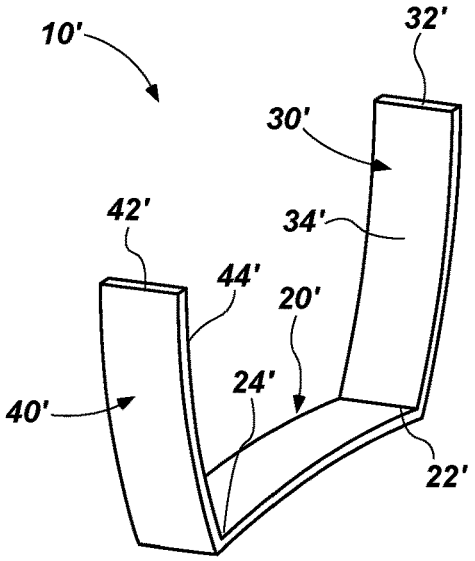
FIGS. 5 and 6 illustrate another embodiment of a shoe-opening spring according to this disclosure in a relaxed arrangement, with the shoe-opening spring including a base with a convex curvature, a medial spring extending upwardly and, optionally, outwardly from a medial end of the base, and a lateral spring extending upwardly and, optionally, outwardly from a lateral end of the base.
Figure 6:
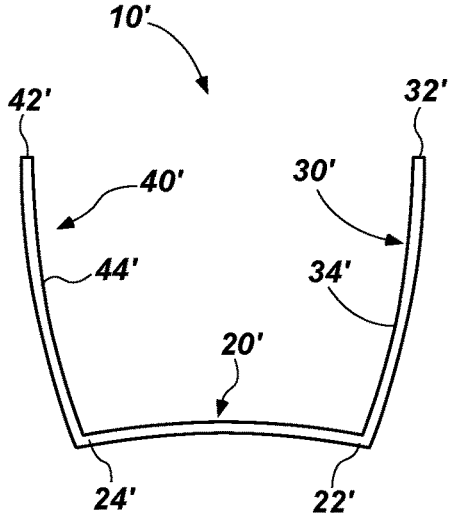

In FIGS. 5 and 6, the shoe-opening spring 10' is shown in a relaxed arrangement, in which it does not store energy. As illustrated by FIGS. 5 and 6, the medial spring 30' and the lateral spring 40' of the shoe-opening spring 10', along with the respective ends 32' and 42' of the medial spring 30' and the lateral spring 40', are oriented relatively far apart from one another.

Figure 7:
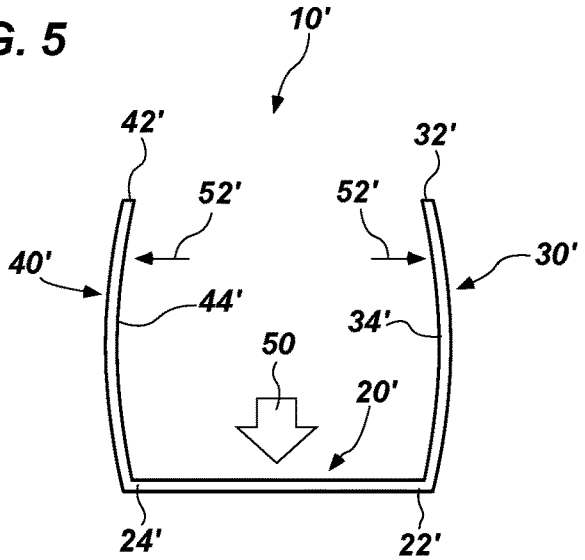
FIG. 7 shows an effect of flattening the convex curvature of the base of the shoe-opening spring of FIGS. 5 and 6 on the orientations of medial spring and the lateral spring.

Again, the base 20' of the shoe-opening spring 10' may be bowed, or it may have a convex curvature between the medial spring 30' and the lateral spring 40'. When a force 50 (e.g., an individual's weight on his or her foot, etc.) is applied to the convex curvature of the base 20', as shown in FIG. 7, the base 20' flattens. As the base 20' flattens, it stores energy. Additionally, flattening of the base 20' forces the medial spring 30' in a medial direction and the lateral spring 40' in a lateral direction, forcing the medial spring 30' and the lateral spring 40 towards one another.

Figure 8:
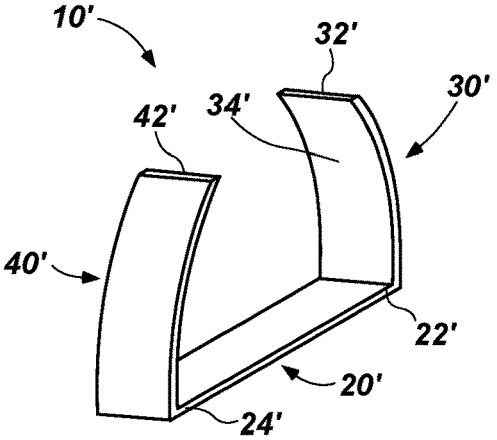
FIGS. 8 and 9 depict the embodiment of the shoe-opening spring of FIGS. 5 and 6 in a tensed arrangement, with an inside surface of the medial spring including a concave curvature that receives a medial side of an individual's foot and an inside surface of the lateral spring including a concave curvature that receives a lateral side of the individual's foot.
Figure 9:
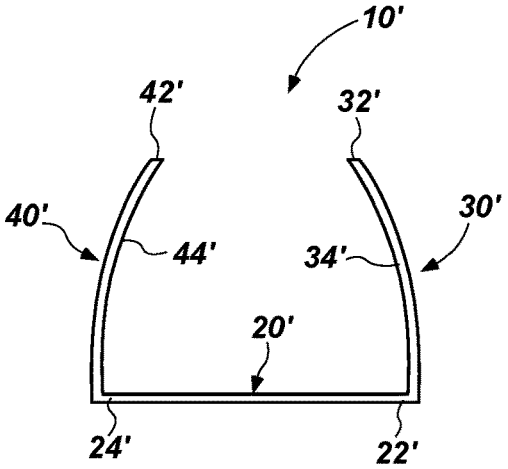

As the medial spring 30' and the lateral spring 40' of the shoe-opening spring 10' are forced toward one another, as illustrated by FIGS. 8 and 9, tension is introduced into the shoe-opening spring 10', as well as into its medial spring 30' and its lateral spring 40', placing the shoe-opening spring 10', its medial spring 30', and its lateral spring 40' in a tensed arrangement. While in the tensed arrangement, the shoe-opening spring 10' stores energy that urges the medial spring 30' medially outward and the lateral spring 40' laterally outward.

In some embodiments, the shapes and/or flexibilities of the medial spring 30' and the lateral spring 40' may enable them to at least partially conform to an individual's foot as the individual's foot is placed in the shoe-opening spring 10' (i.e., on the base 20', between the medial spring 30' and the lateral spring 40') and the shoe-opening spring 10' is placed in its tensed arrangement. An inside surface of the medial spring 30' may assume a concave curvature that, when positioned adjacent to a medial side of a foot, receives the medial side of the foot without exerting pressure on or being felt by the medial side of the foot. An inside surface of the lateral spring 40' may assume a concave curvature that, when positioned adjacent to a lateral side of the foot, receives the lateral side of the foot without exerting pressure against or being felt by the lateral side of the foot.

With reference to FIGS. 10-13, an embodiment of a self-opening shoe 100 that includes a shoe-opening spring 10 (or any other embodiment of a shoe-opening spring) is shown. For the sake of simplicity, the self-opening shoe 100 may be referred to hereinafter as a "shoe 100."

Figure 11:
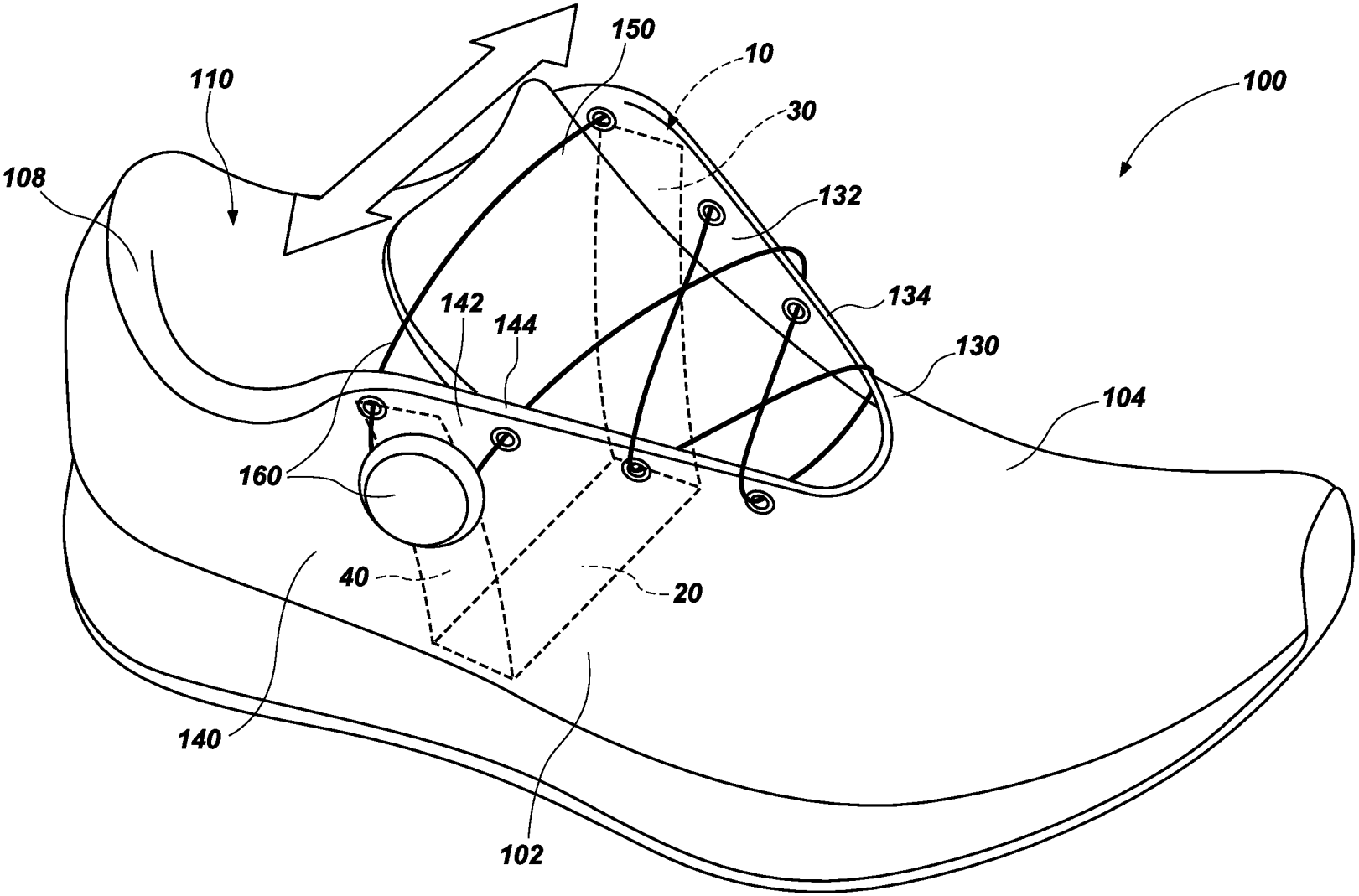
FIG. 11 adds a representation of a closure to the shoe shown in FIG. 10.
Figure 13:
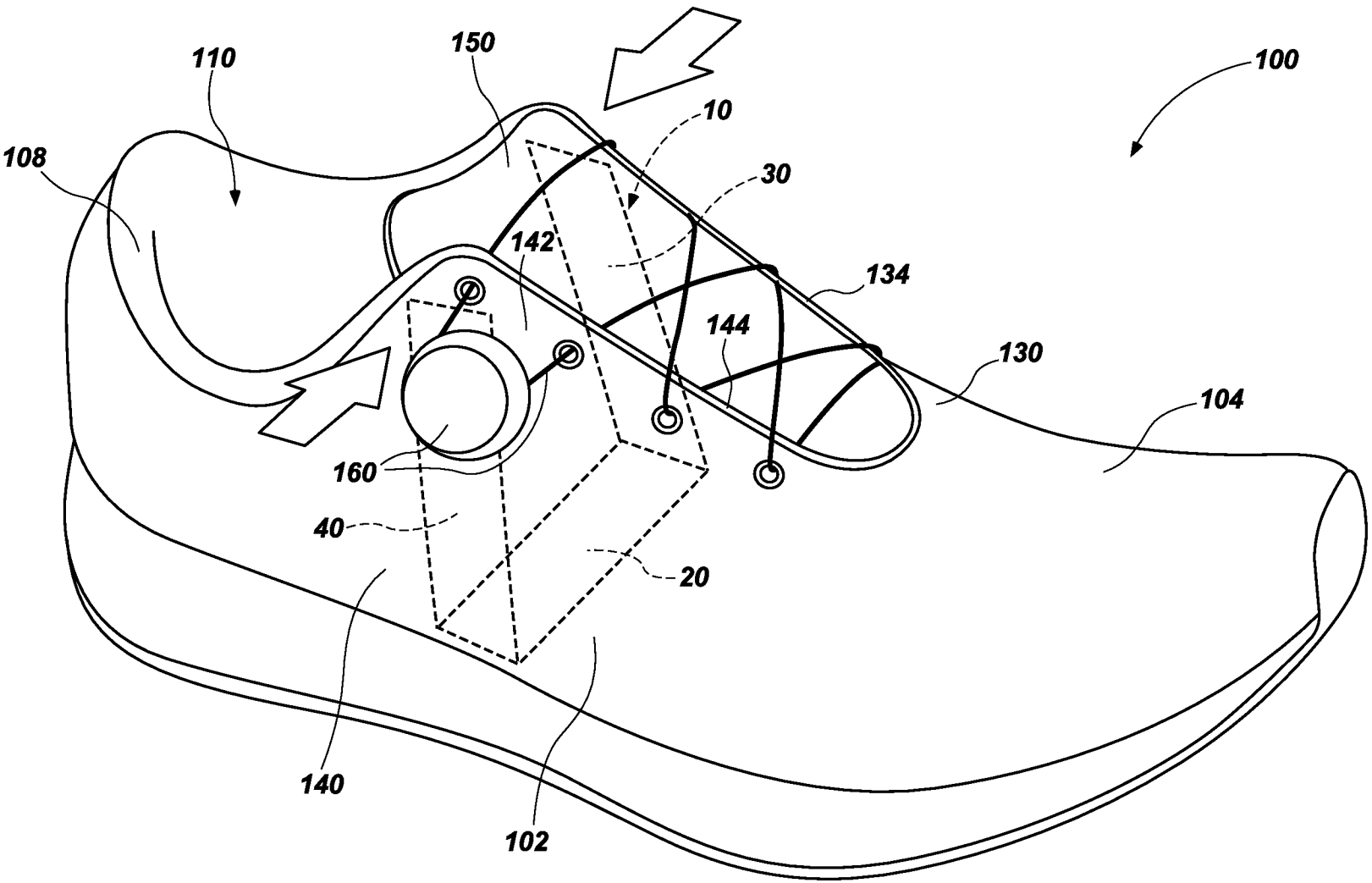
FIG. 13 adds a representation of the closure to the shoe shown in FIG. 12, with the closure pulling the upper medial edge and the upper lateral edge towards each other.

Among other parts and features, the shoe 100 includes a foot bed 102, an upper 104 over the foot bed, and a closure 160 (FIGS. 11 and 13). The upper 104 may include, among various other features, a medial side 130 and a lateral side 140. The medial side may include an upper medial portion 132 and an upper medial edge 134. The lateral side 140 may include an upper lateral portion 142 and an upper lateral edge 144. The upper 104 may also include a collar 108 and a tongue 150.

The medial side 130 of the upper 104 may be positioned to cover a medial side of a foot within the shoe 100 and the lateral side 140 of the upper 104 may be positioned to cover a lateral side of the foot. The upper medial portion 132 of the medial side 130 of the upper 104 may extend, or wrap, over a medial side of the top of the foot, while the upper lateral portion 142 of the lateral side 140 of the upper 104 may extend, or wrap, over a lateral side of the top of the foot.

The collar 108 extends around a back of the shoe 100, connecting the upper medial edge 134 of the medial side 130 of the upper 104 and the upper medial edge 144 of the lateral side 140 of the upper 104. The collar 108 defines an opening 110 of the shoe 100. When the shoe 100 has been placed on an individual's foot, the collar 108 may extend around the individual's ankle.

The tongue 150 of the shoe 100 may be positioned beneath the upper medial portion 132 and the upper medial edge 134 of the medial side 130 of the upper 104 of the shoe 100 and beneath the upper lateral portion 142 and the upper lateral edge 144 of the lateral side 140 of the upper 104.

The closure 160, a representation of which can be seen in FIGS. 11 and 13, may be associated with the upper medial edge 134 of the upper medial portion 132 of the medial side 130 of the upper 104 of the shoe 100 and the upper lateral edge 144 of the upper lateral portion 142 of the lateral side 140 of the upper 104 of the shoe 100. The closure 160 may comprise any suitable type of closure for a shoe. As an example, the closure 160 may comprise eyelets or equivalent features positioned along the upper medial edge 134 and the upper lateral edge 144 and a conventional shoe lace that extends through the eyelets or equivalent features. As another example, the closure 160 may comprise one or more straps and corresponding buckles. In yet another example, the closure 160 may comprise a cinching element of the type available from Boa Technology of Steamboat Springs, Colorado, a suitable cord, and corresponding eyelets or equivalent features positioned along the upper medial edge 134 and the upper lateral edge 144.

Figure 10:
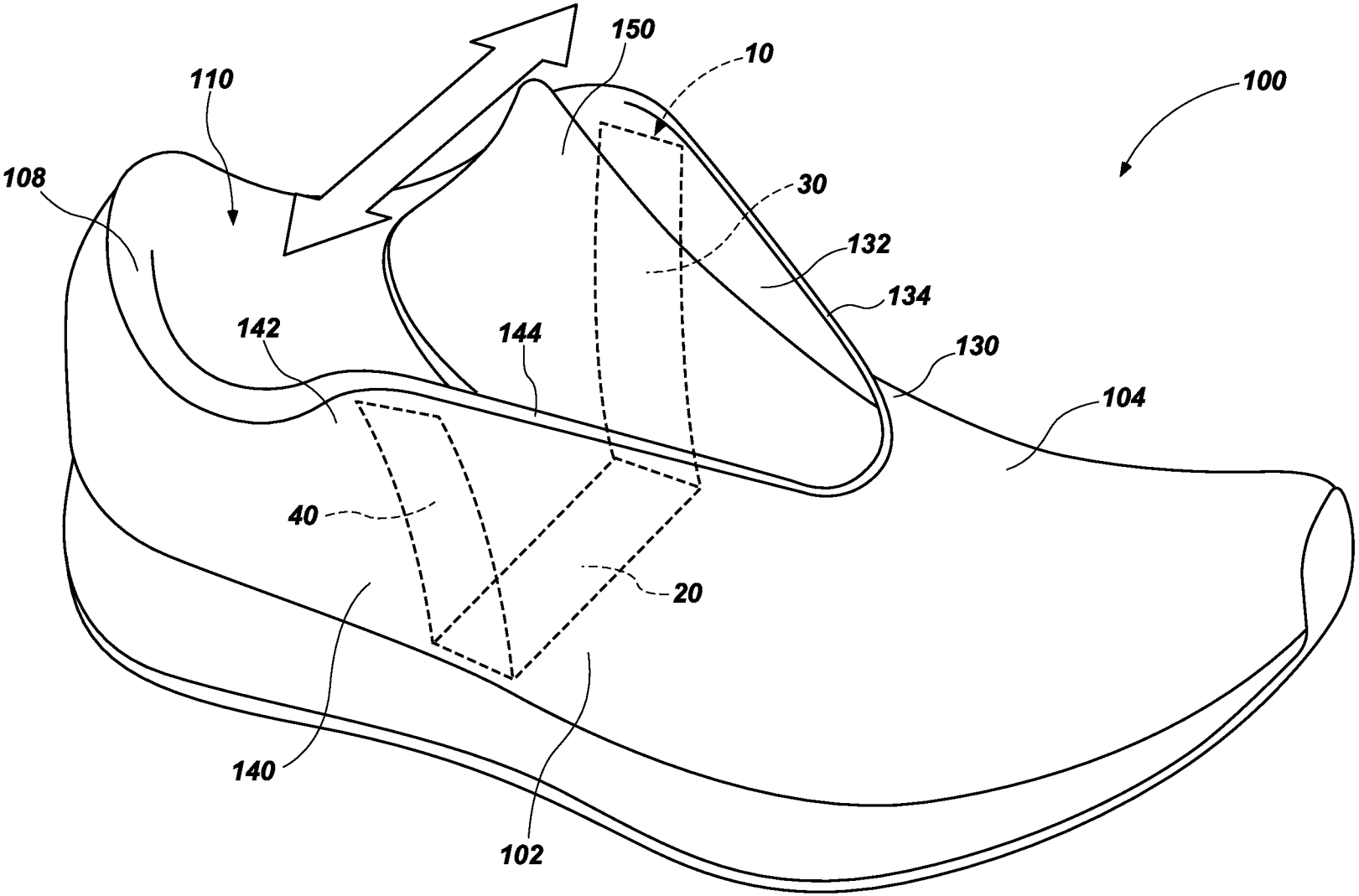
FIG. 10 provides a representation of a shoe with a self-opening spring therein in a relaxed arrangement, with a medial spring of the shoe-opening spring forcing a medial side of an upper of the shoe medially outward and a lateral spring of the shoe-opening spring forcing a lateral side of the upper of the shoe laterally outward to increase or even maximize a size of an opening of the shoe.

When the closure 160 is loosened, or placed in an open state, the upper medial edge 134 and the upper lateral edge 144 may be pulled apart from each other, enabling the size of the opening 110 of the shoe 100 to be increased or even maximized, as illustrated by FIGS. 10 and 11. More specifically, the medial spring 30 of the shoe-opening spring 10 may force the medial side 130 of the upper 104 of the shoe 100, as well as the upper medial portion 132 and the upper medial edge 134 of the upper medial side 130, medially outward. The lateral spring 40 of the shoe-opening spring 10 may force the lateral side 140 of the upper 104 of the shoe 100, as well as the upper lateral portion 142 and the upper lateral edge 144 of the upper lateral side 140, laterally outward. Such movement may increase the size of the opening 110 to an extent that will enable an individual to insert his or her foot into the opening 110 and into the shoe 100 with little or no resistance.

Figure 12:
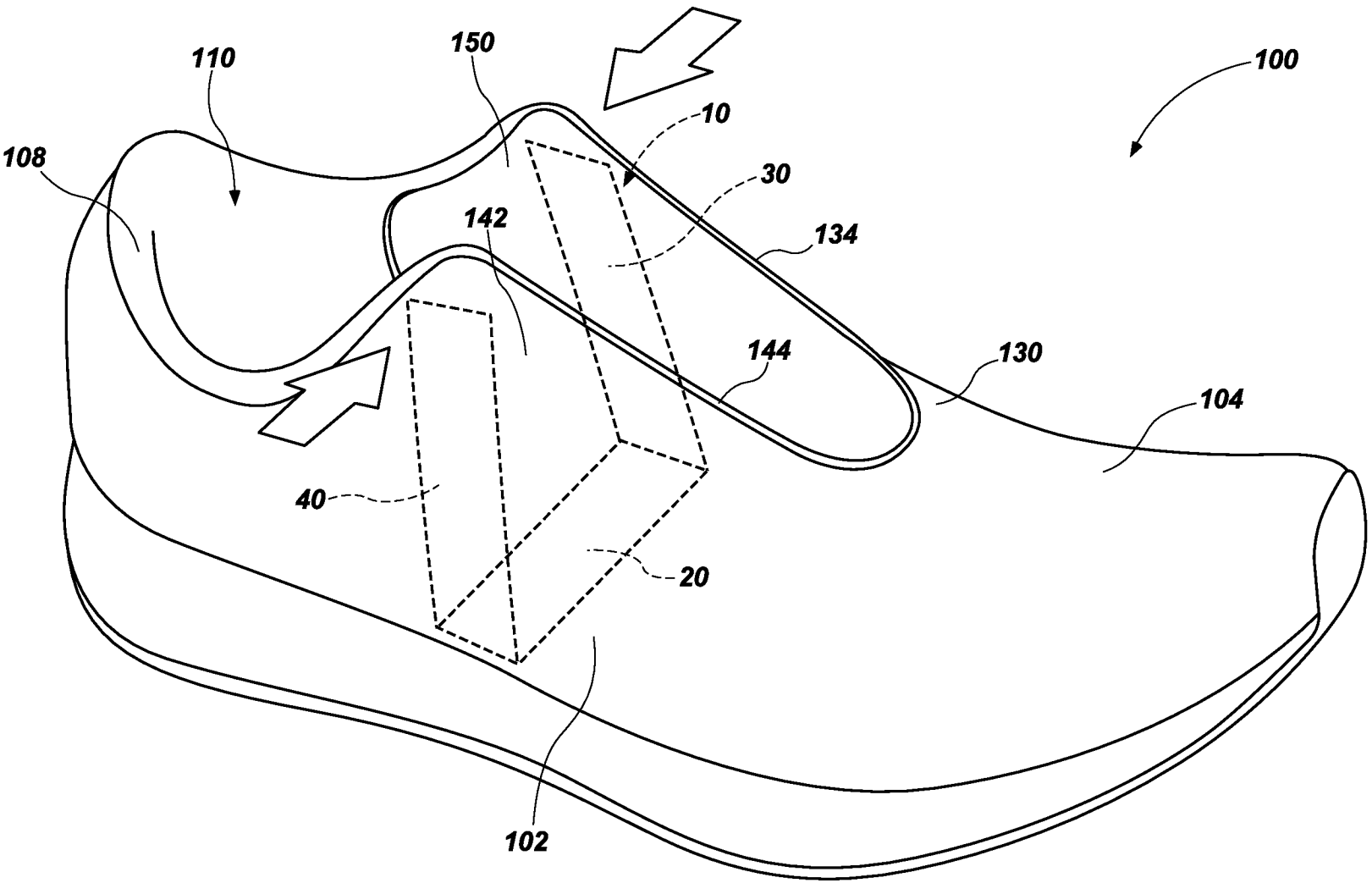
FIG. 12 provides a representation of a shoe with a self-opening spring therein in a tensed arrangement, with the medial spring and the lateral spring of the shoe-opening spring being forced towards one another (e.g., the medial spring being forced laterally and the lateral spring being forced medially) as an upper medial edge of the medial side of an upper of the shoe and an upper lateral edge of the lateral side of the shoe are pulled towards each other to decrease the size of the opening of the shoe.

Upon tightening the closure 160, or its placement in a closed state, as shown in FIG. 13, the opening 110 of the shoe 100 may be closed to secure the shoe 100 to a foot therein. More specifically, tightening of the closure 160 and its placement in the closed state may pull the upper medial edge 134 and the upper lateral edge 144 toward one another and reduce a size of the opening 110 of the shoe 100. As the upper medial edge 134 and the upper lateral edge 144 are pulled toward each other, as shown in FIGS. 12 and 13, they may respectively force the medial spring 30 and the lateral spring 40 of the shoe-opening spring 10 together, introducing tension into the shoe-opening spring 10. With the shoe-opening spring 10 in its tensed arrangement, it stores energy that may be subsequently used to facilitate placement of the closure 160 in its open state, increase the size of the opening 110 of the shoe, and/or facilitate removal of a foot from the shoe 100, possibly with little or no resistance.

The shoe 100 may include a wide toe box for optimal foot comfort, performance, and/or health. The shoe 100 may include a neutral drop from front to back. The shoe 100 may include secure built-in points-of-entry for the hooks of the ELEVATE® drop foot brace available from Foot Scientific of Draper, Utah.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A self-opening shoe, comprising:
- a shoe, including:
  - a foot bed;
  - an upper over the foot bed, the upper including:
    - a medial side including an upper medial portion and an upper medial edge;
    - a lateral side including an upper lateral portion and an upper lateral edge; and
    - a collar defining an opening of the shoe;
  - a tongue positioned beneath the upper medial edge and the upper lateral edge of the upper; and
  - a closure associated with the upper medial edge and the upper lateral edge and positioned over a portion of the tongue; and
- a shoe-opening spring, including:
  - a base extending across the foot bed at a location beneath the tongue, the base including a medial end and a lateral end;
  - a medial spring extending upwardly from the medial end of the base, the medial spring forcing the upper medial portion of the medial side of the upper medially outward; and
  - a lateral spring extending upwardly from the lateral end of the base, the lateral spring forcing the upper lateral portion of the lateral side of the upper laterally outward.

2. The self-opening shoe of claim 1, wherein the medial spring and the lateral spring of the shoe-opening spring together maximize a size of the opening defined by the collar of the upper of the shoe to facilitate introduction of a foot into the opening and into the shoe and removal of the foot from the shoe and out of the opening.

3. The self-opening shoe of claim 1, wherein the closure pulls the upper medial edge and the upper lateral edge toward each other, forces the medial spring and the lateral spring toward one another, and reduces a size of the opening defined by the collar.

4. The self-opening shoe of claim 1, wherein the medial spring and the lateral spring, upon releasing the closure, together loosen the closure.

5. The self-opening shoe of claim 1, wherein the base of the shoe-opening spring includes a convex curvature between the medial spring and the lateral spring.

6. The self-opening shoe of claim 5, wherein a foot, upon being introduced into the shoe, flattens the convex curvature of the base and forces the medial spring and the lateral spring toward one another.

7. The self-opening shoe of claim 1, wherein the closure comprises a lacing system.

8. The self-opening shoe of claim 1, wherein the base of the spring is positioned beneath an insole of the shoe.

9. The self-opening shoe of claim 1, wherein:

the medial spring is incorporated into the medial side of the upper; and the lateral spring is incorporated into the lateral side of the upper.

10. The self-opening shoe of claim 1, wherein the shoe-opening spring is removable from the shoe.

11. The self-opening shoe of claim 1, wherein:

the medial spring exerts a medially outward force sufficient to force the medial side of the upper of the shoe outward a desired medial distance;

the lateral spring exerts a laterally outward force sufficient to force the lateral side of the upper of the shoe outward a desired lateral distance; and the desired medial distance and the desired lateral distance enlarge the opening of the shoe.

12. The self-opening shoe of claim 1, wherein:

an inside surface of the medial spring of the shoe-opening spring has a concave curvature; and an inside surface of the lateral spring of the shoe-opening spring has a concave curvature.

13. The self-opening shoe of claim 12, wherein:

the concave curvature of the inside surface of the medial spring of the shoe-opening spring, when positioned adjacent to a medial side of a foot, receives the medial side of the foot without exerting pressure on the medial side of the foot; and the concave curvature of the inside surface of the lateral spring of the shoe-opening spring, when positioned adjacent to a lateral side of the foot, receives the lateral side of the foot without exerting pressure on the lateral side of the foot.

* * * * *